US005919737A

United States Patent [19]

Broide

[11] Patent Number: 5,919,737

[45] Date of Patent: Jul. 6, 1999

[54] METHOD OF SEPARATING A SUPERCONDUCTING FRACTION FROM A MIXTURE

[76] Inventor: Efim Broide, Masaryk 7/6, Bat Yam, Israel

[21] Appl. No.: 09/063,296

[22] Filed: Apr. 21, 1998

[51] Int. Cl.[6] ..... B03C 1/021

[52] U.S. Cl. ..... 505/400; 505/727; 505/933; 209/232; 209/218

[58] Field of Search ..... 505/400, 727, 505/932, 933; 209/39, 40, 567, 635, 636, 696, 232, 218

[56] References Cited

U.S. PATENT DOCUMENTS

| | | | |
|---|---|---|---|
| 2,813,628 | 11/1957 | Klaus | 209/218 |
| 3,124,527 | 3/1964 | Watanabe et al. | 209/218 |
| 4,828,685 | 5/1989 | Stephens | 209/11 |
| 5,049,540 | 9/1991 | Park et al. | 505/1 |
| 5,268,353 | 12/1993 | Ohara et al. | 505/1 |
| 5,280,011 | 1/1994 | Kraitsberg | 505/1 |

OTHER PUBLICATIONS

Eriez Magnetics, P.O. Box 10608, Erie, PA 16514–0608, Brochure, No Pub Date.

Vibco Inc., P.O. Box 8, Wyoming, RI 02898, Brochure, No Pub Date.

Eriez Magnetics, P.O. Box 10608, Erie, PA 16514–0608, "Maagnetic Ideas", brochure No Pub Date.

Eriez Magnetics, P.O. Box 10608, Erie, PA 16514–0608, "All Product Brochure", brochure No Pub Date.

*Primary Examiner*—Mark Kopec

*Attorney, Agent, or Firm*—Mark M. Friedman

[57] ABSTRACT

A method for separating a powder into a superconducting fraction and a tailing fraction, or of separating a powder into a magnetically active fraction and a tailing fraction. The powder is mixed with a paramagnetic liquid to form a slurry. The slurry is poured down an incline while being subjected to a downslope-traveling magnetic field. The superconducting or magnetically active particles move upslope.

9 Claims, 5 Drawing Sheets

METHOD OF SEPARATING A SUPERCONDUCTING FRACTION FROM A MIXTURE

FIELD AND BACKGROUND OF THE INVENTION

The present invention relates to electromagnetic separation methods and, more particularly, to a method of separating a superconducting powder from a mixture with other powders.

The advent of high temperature ceramic superconductors has raised the prospect of using liquid nitrogen rather than liquid helium as a coolant for superconducting devices. One problem with these high temperature superconductors is that, as conventionally synthesized, they consist of mixtures of different phases having different superconductivity transition temperatures. Some of these phases are in fact not superconductive at all.

It has been proposed to separate powdered mixtures of ceramic superconductors into superconducting and nonsuperconducting fractions by moving the powder through a static, permanent magnetic field. By the Meissner effect, the magnetic field repels the superconducting fraction. Representative patents disclosing such methods include U.S. Pat. No. 4,828,685, to Stephens, U.S. Pat. No. 5,049,540, to Park et al., and U.S. Pat. No. 5,268,353, to Ohara et al.

SUMMARY OF THE INVENTION

According to the present invention there is provided a method for separating a powder including a superconducting fraction having a certain superconducting transition temperature and a tailing fraction, including the steps of: (a) suspending the powder in a liquid at a temperature below the superconducting transition temperature, thereby forming a suspension; and (b) imposing a traveling magnetic field, having a certain travel direction, on the suspension; thereby causing the superconducting fraction to move in a direction opposite to the travel direction.

According to the present invention there is provided a method for separating a powder including a magnetically active fraction and a tailing fraction, including the steps of: (a) suspending the powder in a paramagnetic liquid, thereby forming a suspension; and (b) imposing a traveling magnetic field, having a certain travel direction, on the suspension; thereby causing the magnetically active fraction to move in a direction opposite to the travel direction.

The present invention is directed primarily at the separation of a superconducting fraction from a mixture of superconducting and nonsuperconducting powders. Indeed, all of the illustrative examples herein are directed towards the separation of a superconducting fraction from such a mixture. It has been found that the present invention also can be used to separate magnetically active powders from magnetically inactive powders, where the term "magnetically active" refers to a material that interacts strongly with a magnetic field, for example a ferromagnetic material or a ferrimagnetic material. In the context of the present invention, the fraction of a powder that is not superconducting, or that is not magnetically active, is referred to as a tailing fraction.

According to the present invention, the powder to be separated is mixed with a paramagnetic liquid, to form a slurry. Preferably, the paramagnetic liquid is a mixture of liquid nitrogen and liquid oxygen. The slurry is poured along a gently inclining plane. On the other side of the plane is a generator of a magnetic field that travels down the direction of the incline. The superconducting or magnetically active particles behave like the rotors of a linear motor, and move opposite to the direction of travel of the magnetic field, up the incline. The tailing fraction of the slurry moves down the incline.

The present invention is based on an electromagnetic interaction between the traveling magnetic field and the slurry. As such, the present invention has several advantages over the prior art methods that are based on the Meissner effect. Among these are that the traveling magnetic field induces density waves in the paramagnetic liquid that promote mechanical separation of the powder particles; and that, at fixed particle size, the speed with which superconducting particles move opposite to the direction of travel of the magnetic field depends on the superconductivity transition temperatures of the particles, enabling segregation of particles according to transition temperature.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
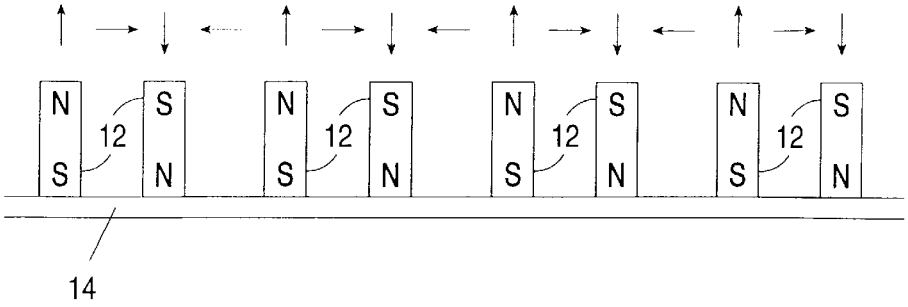
FIGS. 1A–1D illustrate the principle of a traveling magnetic field.
Figure 1B:
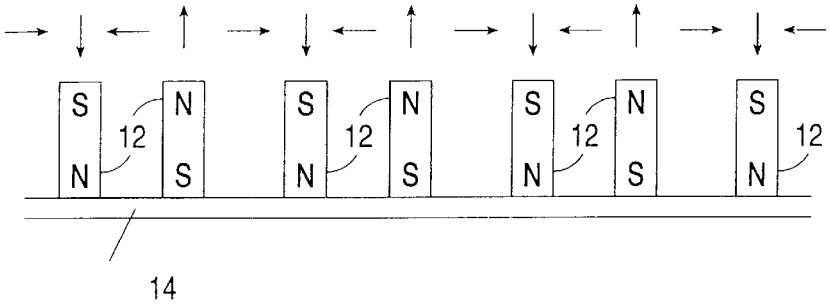
Figure 1C:
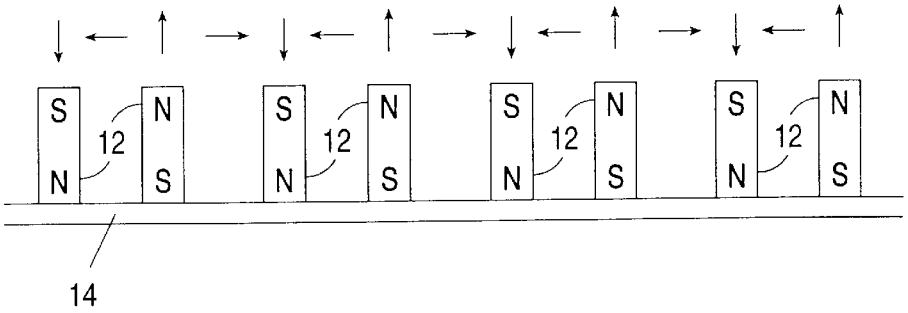
Figure 1D:
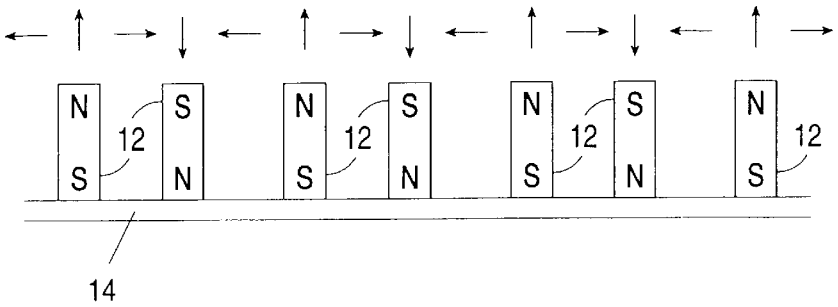

The present invention is of a method for separating a superconducting fraction, or a magnetically active fraction, from a powdered mixture that includes that fraction and a tailing fraction.

The principles and operation of powder separation according to the present invention may be better understood with reference to the drawings and the accompanying description.

Referring now to the drawings, FIGS. 1A–1D illustrate a mechanism for generating a traveling magnetic field. Permanent magnets 12 of alternating polarities are mounted on a conveyor belt 14 that moves magnets leftward. FIGS. 1A–1D show successive positions of magnets 12 as conveyor belt 14 carries magnets 12 leftward. Thus, the magnetic field created by magnets 12 also travels leftward. The arrows above magnets 12 show the directions of the magnetic field vector above magnets 12. At a fixed location in space, the magnetic field vector rotates clockwise. It will be readily apparent to those ordinarily skilled in the art that the same effect can be obtained using appropriately synchronized alternating currents in solenoids, as is in fact done in linear motors.

Figure 2:
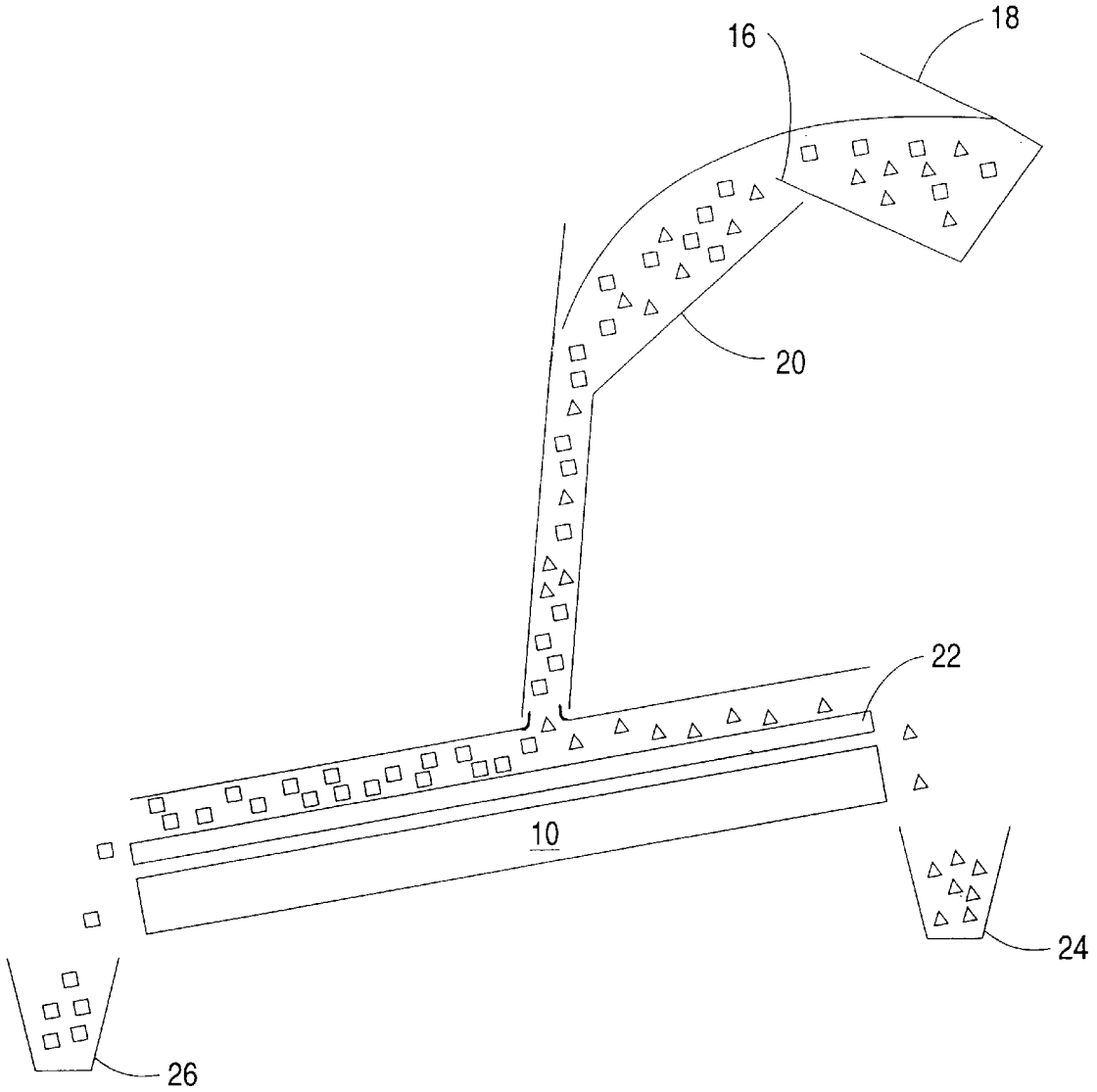
FIG. 2 is a schematic illustration of an apparatus for implementing the present invention.

FIG. 2 shows schematically an apparatus for implementing the present invention. A powder to be separated is mixed with a paramagnetic cryogenic liquid in a container 18 to form a slurry 16. Particles of the superconducting fraction of the powder are represented symbolically as triangles. Particles of the tailing fraction of the powder are represented symbolically as squares. Slurry 16 is poured into a hopper 20, wherefrom slurry 16 emerges onto an inclined plane 22. Below inclined plane 22 is a generator 10 of a traveling magnetic field. Generator 10 may be the permanent-magnet-based system illustrated partially in FIGS. 1A–1D, an equivalent solenoid-based system, or any other equivalent mechanism for generating a traveling magnetic field. The traveling magnetic field created by generator 10 causes the superconducting particles to move upslope and fall into a receiver 24. The tailing particles move downslope under the influence of gravity and fall into another receiver 26. At the two ends of inclined plane 22, the paramagnetic liquid may be allowed to evaporate, or may be collected for recycling.

Strictly speaking, the liquid used to create slurry 16 need not be paramagnetic. As noted above, all that is strictly necessary for the operation of the present invention is that the superconducting particles behave as the rotors of a linear motor, and move upslope and away from the tailings. Of course, the liquid must be cryogenic, to cool the superconducting particles below their superconducting transition temperature. It is preferable that the liquid be paramagnetic, so that the time-varying magnetic field created by generator 10 creates density waves in the slurry that enhance the separation of the various powder fractions based on their densities. Preferably, the cryogenic paramagnetic liquid is liquid nitrogen with an admixture of liquid oxygen. Although liquid air, which is about 80% nitrogen and about 20% oxygen, is a suitable candidate for the cryogenic paramagnetic liquid, the optimum concentration of liquid oxygen is a tradeoff between enhanced paramagnetism, which is promoted by a high concentration of oxygen, and fire safety considerations, which require a low concentration of oxygen. In practice, a concentration of between 1% and 2% by weight of oxygen has been found to be both effective and safe. This concentration is achieved by allowing liquid nitrogen to stand exposed to ambient air long enough to take up sufficient atmospheric oxygen.

Preferably, the maximum magnetic field strength of the traveling magnetic field, just above inclined plane 22, is between about 0.01 T and about 2 T. Preferably, the slope of inclined plane 22 is between about 1° and about 20°.

Figure 3:
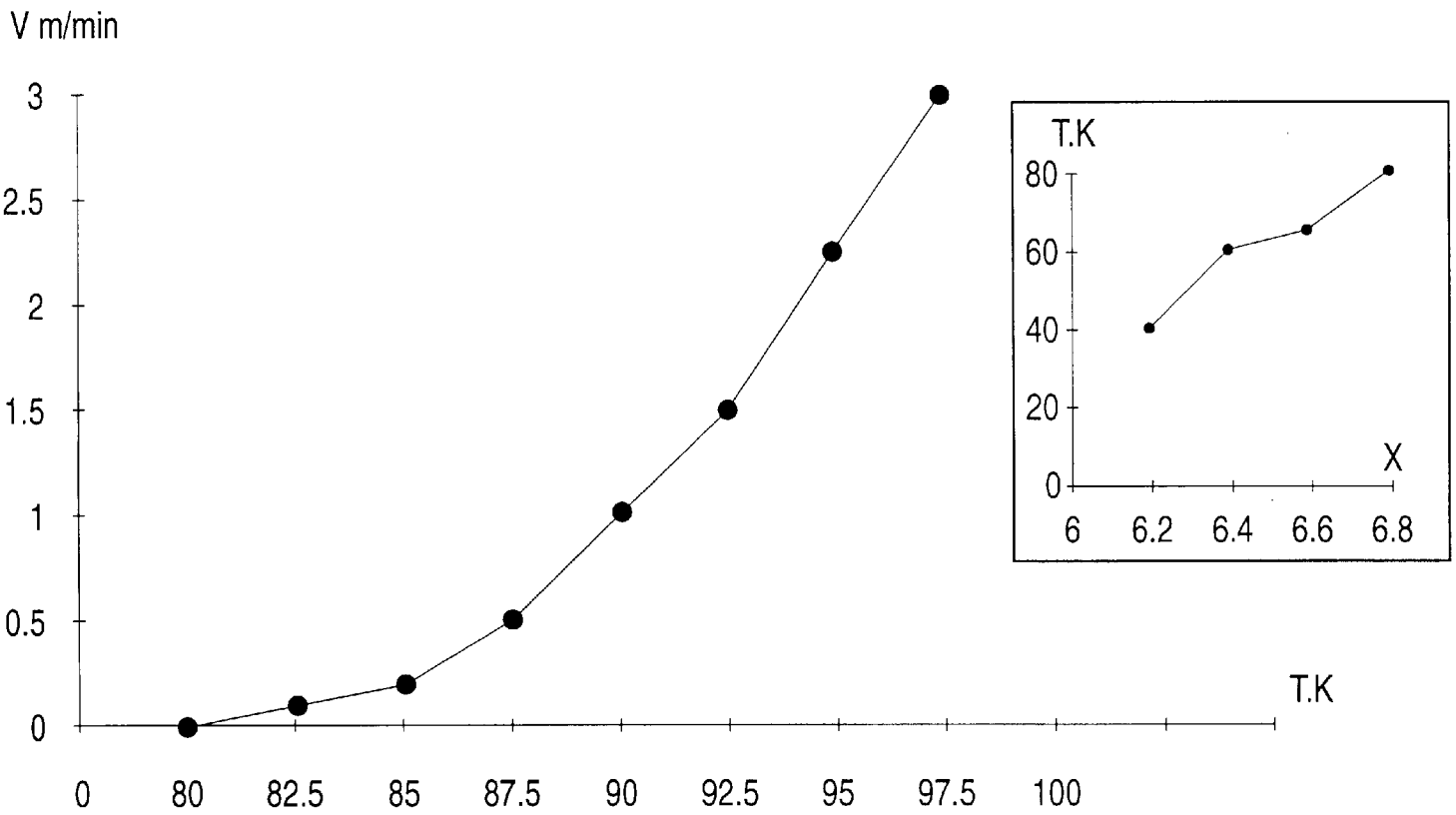
FIG. 3 is a plot of $YBa_2Cu_3O_x$ particle velocity vs. transition temperature.

The traveling magnetic field also fractionates the superconducting particles according to their transition temperatures, because the particles of higher transition temperatures move upslope faster than the particles of lower transition temperatures. FIG. 3 shows experimental results for a $YBa_2Cu_3O_x$ powder of uniform 40 micron particle size in a 0.1 T traveling magnetic field. The insert shows the superconducting transition temperature of $YBa_2Cu_3O_x$ as a function of x, for $6<x<6.8$, The larger graph shows measured velocities, in meters per minute, for particles with $x>6.8$, vs. the particles' superconducting transition temperatures in °K.

Figure 4A:
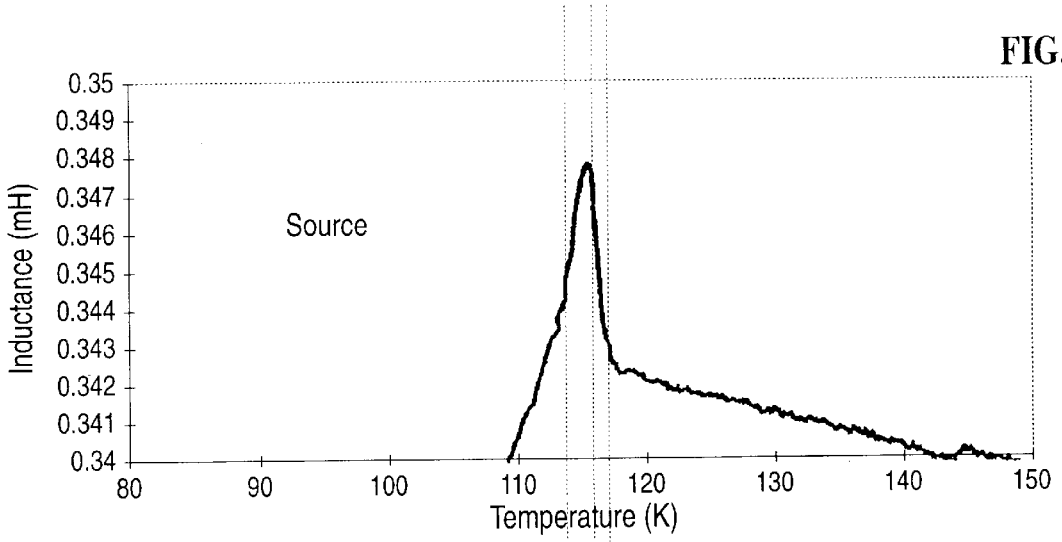
FIGS. 4A–4C are plots of inductance vs. temperature for a Bi(Pb) sample before and after being separated according to the present invention.
Figure 4B:
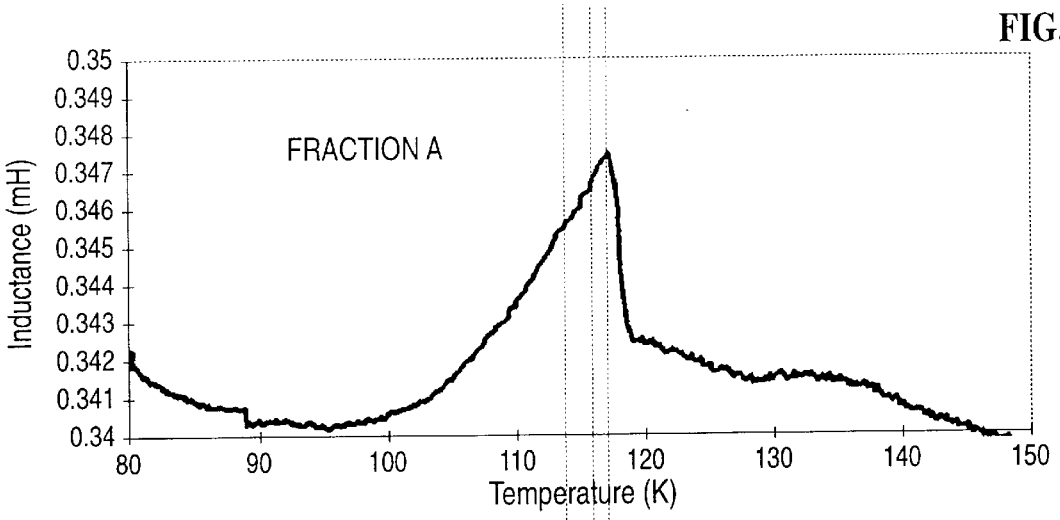
Figure 4C:
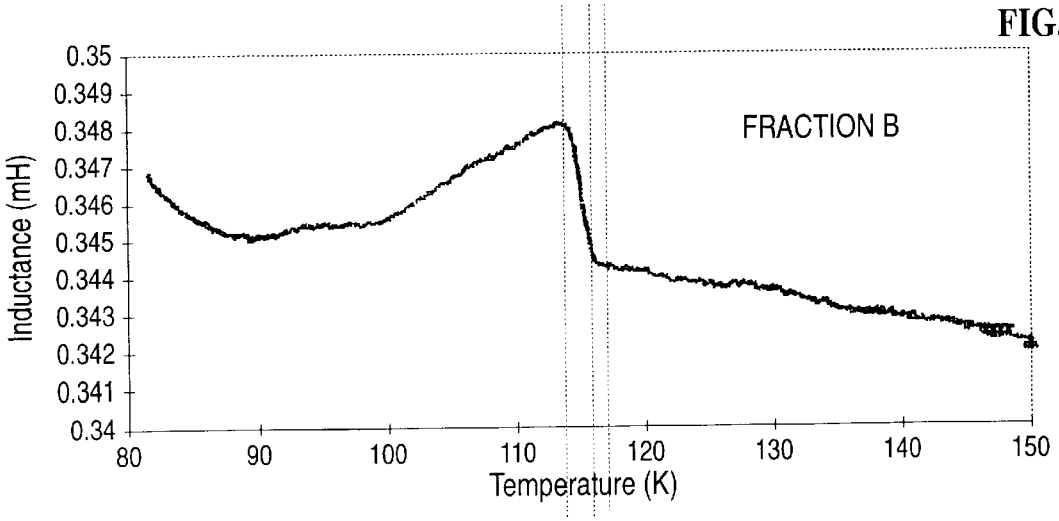

The present invention was used to separate a mixture of Bi(Pb) 2212 and 2223 phases, whose superconducting transition temperatures are about 100° K. and about 120° K., respectively. FIG. 4A shows the inductance of a sample of the initial mixture ("source"), in millineries, as a function of temperature. FIG. 4B shows the inductance of a sample of the same volume of the superconducting fraction collected initially ("fraction A") in receiver 24. FIG. 4C shows the inductance of a sample of the same volume of the superconducting fraction collected subsequently ("fraction B") in receiver 24. The two fractions are segregated by having different velocities up inclined plane 22: fraction A, having a higher superconducting transition temperature, travels up inclined plane 22 faster than fraction B. Note that the phase transition of fraction A is sharper than the phase transition either of the source mixture or of fraction B, and that the peak induction of fraction A is at a higher temperature than the peak induction of the source mixture, which in turn is at a higher temperature than the peak induction of fraction B. This demonstrates that fraction A is purer than the source, and is enriched in the 2223 phase relative to the source; and that fraction B is enriched in the 2212 phase relative to the source.

Figure 5:
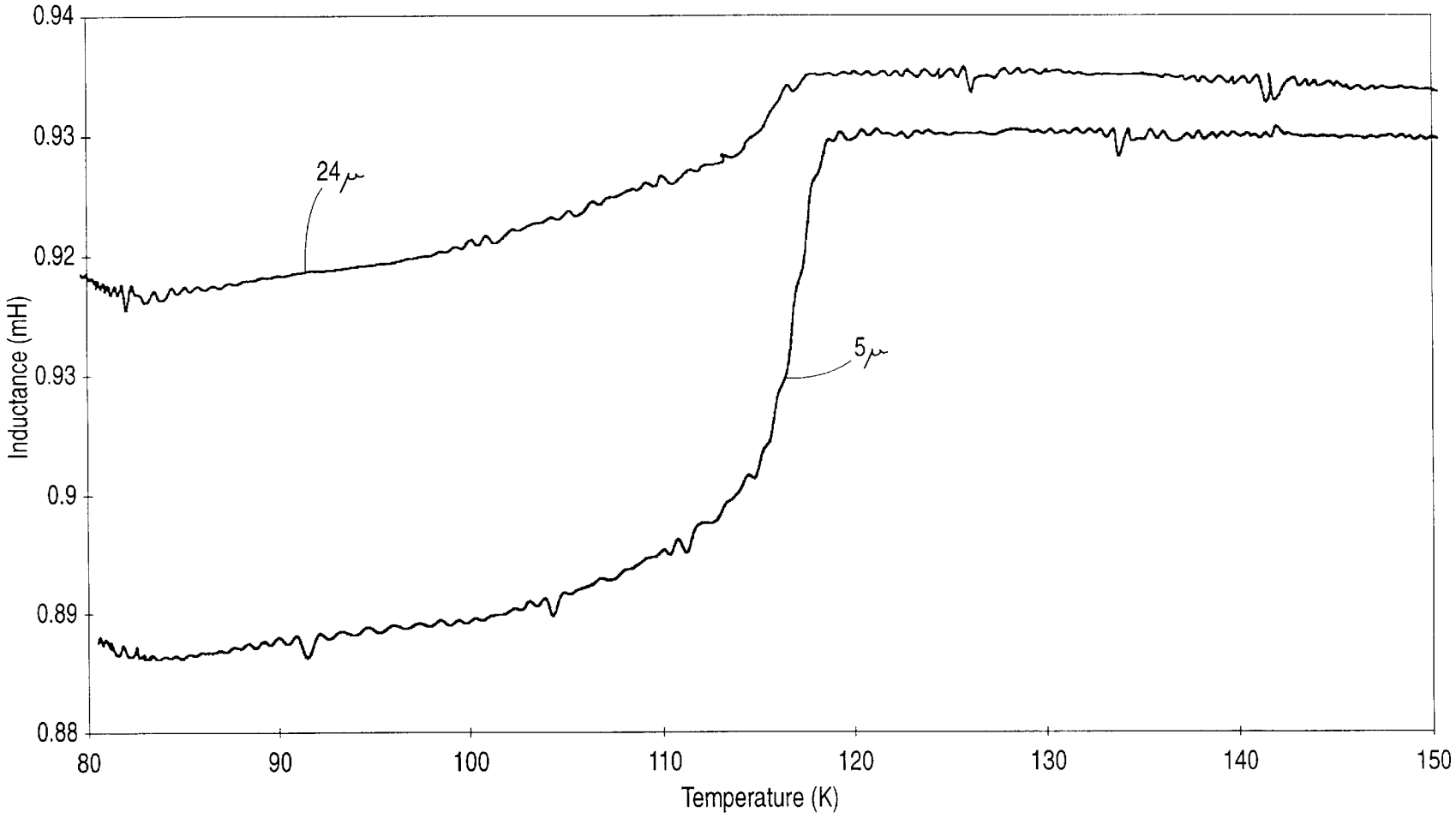
FIG. 5 shows plots of inductance vs. temperature for Bi(Pb) samples of two different particle sizes.

Most preferably, the particles of the mixture are reduced to a size between 1 micron and 10 microns before being subjected to the separation process of the present invention. FIG. 5 shows inductance vs. temperature curves for high-superconductivity-transition-temperature fractions produced from two other Bi(Pb) mixtures. The upper curve is for a sample produced from a mixture whose mean particle size was 24 microns. The lower curve is for a sample of the same volume produced from a mixture whose mean particle size was 5 microns. The relative sharpness of the degree of separation of the 5 micron particles, compared to the degree of separation of the 24 micron particles, is self evident.

While the invention has been described with respect to a limited number of embodiments, it will be appreciated that many variations, modifications and other applications of the invention may be made.

What is claimed is:

1. A method for separating a powder including a superconducting fraction having a certain superconducting transition temperature and a tailing fraction, comprising the steps of:

(a) suspending the powder in a liquid at a temperature below said superconducting transition temperature, thereby forming a suspension; and (b) imposing a traveling magnetic field, having a certain travel direction, on said suspension; thereby causing the superconducting fraction to move in a direction opposite to said travel direction.

2. The method of claim 1, wherein said liquid is paramagnetic.

3. The method of claim 2, wherein said liquid includes oxygen.

4. The method of claim 3, wherein said oxygen is present in said liquid at a weight percentage between about 1% and about 2%.

5. The method of claim 1, further comprising the step of:

(c) causing said suspension to flow parallel to said travel direction.

6. The method of claim 5, wherein said causing of said suspension to flow parallel to said travel direction is effected by pouring said suspension onto an inclined plane.

7. The method of claim 6, wherein said inclined plane is inclined at an angle between about 1° to an angle of about 20°.

8. The method of claim 1, wherein said magnetic field has a magnetic field strength between about 0.01 T and about 2 T.

9. The method of claim 1, further comprising the step of:

(c) reducing the powder to a mean particle size between about 1 micron and about 10 microns, prior to said suspending of the powder in said liquid.

* * * * *